US005390656A

United States Patent [19]

Villa et al.

[11] Patent Number: 5,390,656

[45] Date of Patent: Feb. 21, 1995

[54] PNEUMATIC STABILIZER

[76] Inventors: Teijo Villa, P.O. Box 482, Terrance Bay, Ontario, P0T 2W0, Canada; Chris Reid, P.O. Box 362, Schreiber, Ontario P0T 2S0, Canada

[21] Appl. No.: 864,652

[22] Filed: Apr. 7, 1992

[51] Int. Cl.[6] ..... F41B 5/00

[52] U.S. Cl. ..... 124/89; 188/379

[58] Field of Search ..... 124/89; 188/379, 380; 267/124, 64.11

[56] References Cited

U.S. PATENT DOCUMENTS

| | | | |
|---|---|---|---|
| 3,628,520 | 12/1971 | Izuta | 124/89 |
| 4,245,612 | 1/1981 | Finlay | 124/89 |
| 4,570,608 | 2/1986 | Masterfield | 124/89 |
| 4,718,647 | 1/1988 | Ludwig | 267/120 X |
| 4,893,606 | 1/1990 | Sisko | 124/89 |
| 4,982,719 | 1/1991 | Haggard et al. | 124/89 |
| 4,986,018 | 1/1991 | McDonald, Jr. . | |
| 5,044,351 | 9/1991 | Pfeifer | 124/89 |

FOREIGN PATENT DOCUMENTS

| | | | |
|---|---|---|---|
| 2575817 | 7/1986 | France | 124/89 |
| 55-66217 | 12/1981 | Japan | 267/124 |
| 197706 | 6/1977 | U.S.S.R. | 188/379 |

*Primary Examiner*—Randolph A. Reese
*Assistant Examiner*—George D. Spisich
*Attorney, Agent, or Firm*—Hoffman, Wasson & Gilter

[57] ABSTRACT

A pneumatic stabilizer for use with a bow, rifle, gun or any other instrument that produces destructive vibrational energy. The stabilizer includes a gas spring having weights secured thereto and structure for releasably attaching the stabilizer to an instrument. When the stabilizer is properly adjusted, it has similar vibrational frequency characteristics similar to the instrument such that the vibrational energy of the instrument is absorbed by the stabilizer.

10 Claims, 3 Drawing Sheets

PNEUMATIC STABILIZER

BACKGROUND OF THE INVENTION

Modern archery equipment is very complex. The bows commonly used today are capable of storing and releasing large quantities of energy. A side effect of the release of these large sums of energy is the vibrations that are passed through the bow's handle. These vibrations are generally absorbed by the arm of the user and very often effect the accuracy of his/her shooting. Additionally, the vibrations create noise that may scare prey away.

Stabilizers are known in the art for dissipating the vibrational energy associated with the use of bows. These devices are generally positioned on the bow riser and include internal mechanisms for displacing the energy before it reaches the user's arm or creates any undesired noises. They function to dissipate the energy by utilizing a variety of damping mechanisms. Stabilizers are also useful in dissipating the energy released in devices other than bows. For example, rifles and guns release large sums of vibrational energy that can be readily dissipated through the use of stabilizers.

For example, U.S. Pat. No. 4,982,719 (Haggard et al) discloses a hydraulic bow stabilizer that utilizes a hydraulic damping arrangement in combination with a pair of springs. U.S. Pat. No. 4,893,606 (Sisko) and U.S. Pat. No. 5,044,351 (Pfeifer) also disclose stabilizing devices that utilize a hydraulic dampening arrangement, in combination with a pair of springs, to dissipate any vibrational energy. Further, U.S. Pat. No. 4,570,608 to Masterfield discloses the use of a fluid filled cylinder for dissipating the energy associated with firing a bow.

In addition to the use of hydraulic dampening structures, the art is well aware of a wide variety of stabilizers having spring biased dampening structures. Exemplary of such devices are the stabilizers disclosed in U.S. Pat. Nos. 3,628,520 (Izuta), 4,245,612 (Finlay), 4,615,327 (Saunders), 4,660,538 (Burgard), and 4,986,018 (McDonald, Jr.).

The instant invention is an advancement over the prior art devices discussed above. First, the prior art devices do not disclose a stabilizer that attempts to dynamically absorb the vibrations of the stabilized instrument by approximating the frequency characteristics of the instrument to be stabilized. Second, none of the prior art devices disclose or suggest the use of a gas spring in a stabilizer. Consequently, the prior art devices fail to disclose the combination of a gas spring and an adjustable weight piston. Additionally, the instant invention requires no venting, is easy to use, and functions quieter than the prior art devices discussed above.

BRIEF SUMMARY OF THE INVENTION

The instant invention relates to a pneumatic stabilizer designed to rid a system of unwanted or destructive vibrational energy. For example, the stabilizer could be used to absorb the vibrational energy produced when an arrow is fired from a bow, or absorb the retort from the firing of a gun or rifle. The instant stabilizer achieves these results by utilizing a gas spring, an adjustable mass, and an optimized dampening element.

The stabilizer functions to counteract the natural vibrational frequency of the instrument being used. For example, when an arrow is fired from a bow, the bow riser, in response to this firing force, vibrates with several degrees of freedom. This results in the production of a composite of natural vibrating frequencies that is unique for each bow structure. This composite makes up a bow's vibrational characteristics and is limited by the number of degrees of freedom a bow has, where the number of degrees of freedom corresponds to the number of natural vibrating frequencies a bow maintains. It should, however, be noted that a bow generally vibrates at appreciable amplitudes at only a very limited number of natural frequencies, and therefore each bow has only a few significant natural frequencies making up its composite frequency.

Additionally, the force vibrations of a bow may exhibit some non-linear behavior in which the elastic restoring force is not proportional to the deflection. As a result, the bow riser's natural frequencies (i.e. the non-linear natural frequencies) are dependent on the amplitude of the vibrations created in the bow.

The vibrational energy imparted to a bow is transmitted to the instant pneumatic stabilizer, which begins to oscillate. optimally the stabilizer should be tuned to vibrate naturally so that it will effectively counteract the vibrational characteristics of the bow riser. This is achieved because the instant stabilizer utilizes a gas spring having non-linear vibrational characteristics and an optimized dampening element, all in combination with an adjustable means, to dynamically absorb the bow's vibrational energy. As a result, the bow's destructive vibrations are effectively reduced, and even eliminated.

The vibrational frequency of the stabilizer can be adjusted to match the vibrational characteristics of the bow riser so that it acts to more effectively absorb the harmful energy produced when a bow is fired. The adjustment is achieved by varying the mass attached to the gas spring's piston. By varying this mass, the vibrating characteristics of the stabilizer can be manipulated in a predictable manner to mimic the vibrating characteristics of the bow riser. When the stabilizer is properly matched with the bow riser (or any other instrument) and the dampening of the stabilizer is optimized, the device functions optimally.

In cases where the stabilizer is used with more dampening elements, such as viscous, friction and hysteretic elements, it acts to dissipate the vibrational energy caused by an exciting force in the original system. Under such conditions, the stabilizer operates in the same manner as when it is set up as an absorber except that the stabilizer does not neutralize the vibrations with vibrations of the same frequency, but acts to dissipate most of the vibrational energy of the instrument through the dampening elements.

In summary, the instant pneumatic stabilizer acts as an absorber in effectively and eloquently absorbing the vibrations of an instrument by approximating the vibrational characteristics of the instrument and performing like a classical vibration absorber. The gas spring utilized in the instant stabilizer is not prone to wear or fatigue in the same manner as the mechanical springs found in prior art devices. Additionally, the gas spring has a quicker response time to disturbances, it is quieter, and can be readily modified by varying the pressure in the subchambers. Further, the adjustable masses that form part of the invention, allow for the creation of the ideal vibrational characteristics to optimally reduce an instrument's vibrations by simple trial and error adjustments.

DETAILED DESCRIPTION OF THE INVENTION

Figure 1:
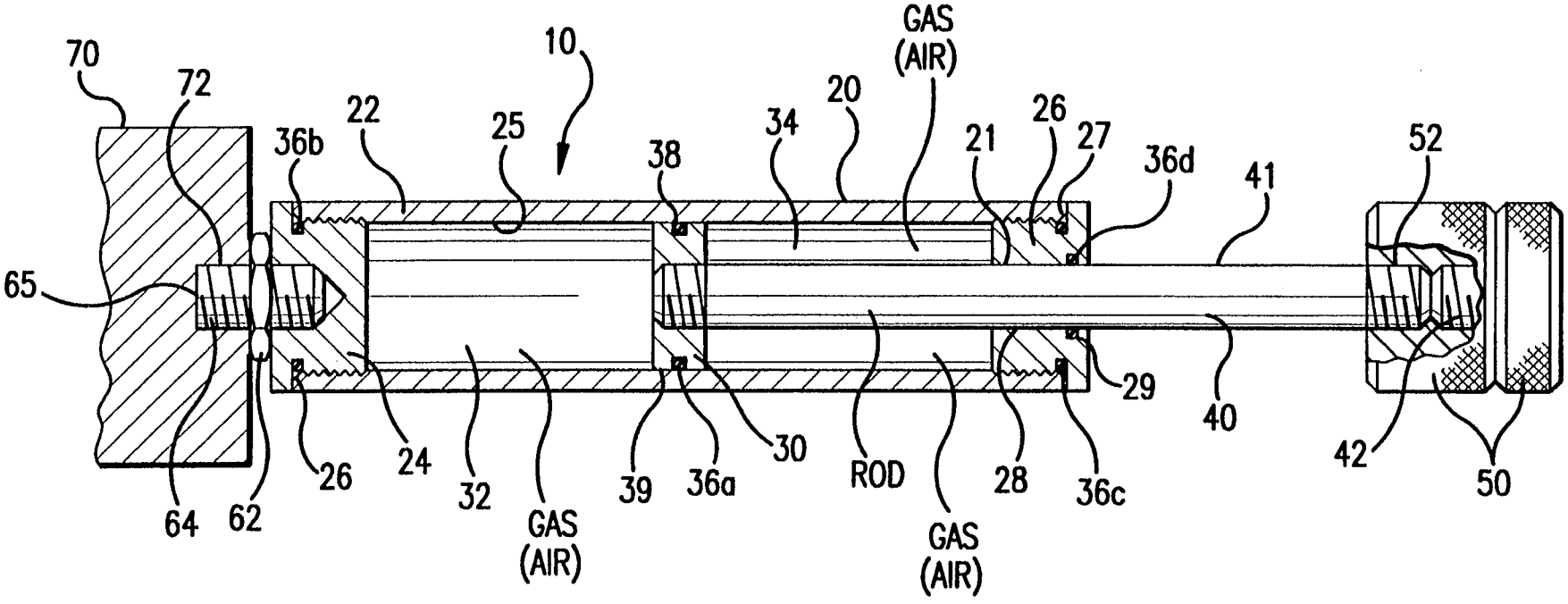
FIG. 1 shows a cross sectional view of the pneumatic stabilizer.

Stabilizer 10 consists of an air tight barrel or cylinder 20 having a piston 30 enclosed within the barrel 20. The piston 30 is actuated by a rod 40 which extends through one end of the barrel 20.

The barrel 20 includes a cylindrical shell 22 with an end plug 24 completely closing one end of the barrel 20. A gland 26 having a central opening 28 is secured to the other end of the cylindrical shell 22 and provides an opening for the rod 40 to extend within the barrel.

The barrel 20 is divided into two air tight chambers 32 and 34 by piston 30. The air tight chambers are maintained by o-rings 36 positioned at a variety of sealed locations within the barrel 20. A first o-ring **36*a* is positioned in a groove 38 formed in the outer periphery 39 of the piston 30 and therefore acts to seal the space between the inner wall 25 of the cylindrical shell 22 and the outer periphery 39 of the piston 30. First o-ring 36*a* also acts as a sealing dampening element in addition to its function of separating air tight chambers 32 and 34. Another o-ring 36*b* is positioned between the end plug 24 and the end wall 26 of the cylindrical shell 22, while another o-ring 36*c* is positioned between the gland 26 and the other end wall 27 of the cylindrical shell 22. A final o-ring 36*d* is positioned in a groove 29 within the inner annular Surface 21 of the gland's central opening 28. O-ring 36*d* acts to seal the space between the inner annular surface 21 and the outer cylindrical surface 41 of the rod 40**.

In the first embodiment that is shown in FIG. 1, the rod includes a set screw 42 at the end opposite the rod's attachment to the piston. Knurled weights 50 are secured to the set screw 42 by internal threading in the weight's central opening 52. The function and operation of the weights 50 within the stabilizer system 10 will be discussed in greater detail subsequently.

In this embodiment, the stabilizer 10 is attached to the instrument 70 by a screw 64 and jam nut 62 that are secured to the end plug 24 and extends outwardly from the barrel 20. The outer end 65 of the screw 64 is threaded such that it can be secured to the instrument by simply screwing the screw 64 into a threaded hole 72 contained on the instrument 70 and setting the jam nut 62.

Figure 2:
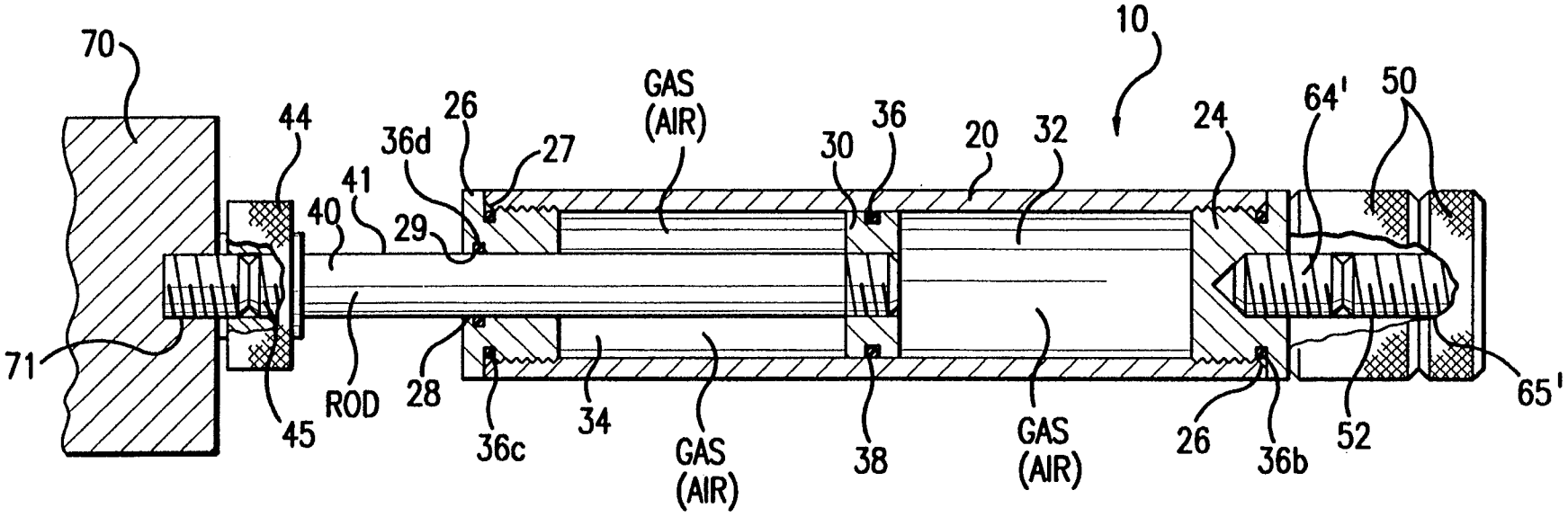
FIG. 2 is a cross sectional view of an alternate embodiment of the pneumatic stabilizer.

An alternate embodiment is shown in FIG. 2 and includes a set screw 64' extending from the end plug 24. The set screw 64' includes a threaded end 65' to which the weights 50 discussed above may be attached. At the opposite end of the rod 40 a screw 44 and jam nut 45 are positioned for securing the stabilizer 10 to the instrument 70. Just as in the other embodiment, the instrument may include an internally threaded hole 71 for receiving the screw 44 and jam nut 45 to allow for attachment of the stabilizer 10 to the instrument 70.

FUNCTION OF THE INVENTION

When the device is used as an absorber, a user attempts to match the vibrational frequencies of the instrument, for example, an archery bow, and the stabilizer. This matching opposes the natural vibrational frequencies of the instrument to effectively reduce, and even outrightly eliminate, the instrument's destructive vibrations.

Figure 3:
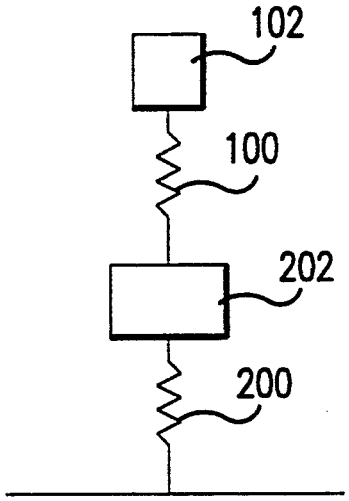
FIG. 3 is a schematic showing the functional aspects of the instant stabilizer.

A schematic expressing the above phenomena is shown in FIG. 3. The stabilizer is represented by spring 100 and weight 102, which have a spring constant $K_2$ and a mass $m_2$, respectively. The vibrating instrument is represented by spring 200 and weight 202, which have a spring constant $K_1$ and a mass $m_1$, respectively. As the instrument and the stabilizer are positioned in series, the stabilizer will best absorb the vibrational energy of the instrument when the natural frequencies of the stabilizer and instrument are equal. That is, when $$\omega_1 \approx \omega_2$$

where $\omega_1$=range of natural frequencies of the instrument; and $\omega_2$=range of tuned frequencies of the stabilizer.

Since the weight 102 of the stabilizer can be adjusted, the range of frequencies $\omega_2$ of the stabilizer can easily be tuned through trial and error to approximately match an instrument's natural frequencies. In the case of the bow, the gas spring in the stabilizer and the sealing dampening element should be optimally pre-set to allow for mass adjustment to produce the best range of frequencies for dynamically absorbing the bow's destructive energy.

Once the appropriate mass has been determined, the adjustable weights of the stabilizer are properly secured to the gas spring. It should be noted that the stabilizer is provided with a wide range of weights that may be selectively secured to the instrument to produce the desired vibrational frequencies of the stabilizer.

Since the instrument will vibrate at its natural frequencies when it is exposed to an impact force, the stabilizer should be set so that it will operate at frequencies approximately equal to the instrument's natural vibrational frequencies when it is intended to function as an absorber. When this is achieved, the pneumatic stabilizer acts as a classical vibration absorber. Consequently, the stabilizer quietly and efficiently provides state of the art reductions in damaging or undesired vibrational energy.

The stabilizer may also be utilized to dissipate the vibrational energy of the instrument, by increasing the dampening effect of the stabilizer. The dampening of the stabilizer may be increased by adding one, or a combination of, several dampening mechanisms. These mechanisms can include viscous dampening (e.g. addition of hydraulic fluids in the subchambers), friction or coulomb dampening, or hysteretic dampening where an energy absorbing material is added.

Under such circumstances, the stabilizer functions in the same manner as when it is intended to act as an absorber except that the object is not to neutralize the vibrations with vibrations of the same frequency, but to dissipate the vibrational energy of the original system within the dampening elements. Again, the adjustable mass is integral to adjusting the stabilizer to provide for the most effective dissipation of energy.

Figure 4:
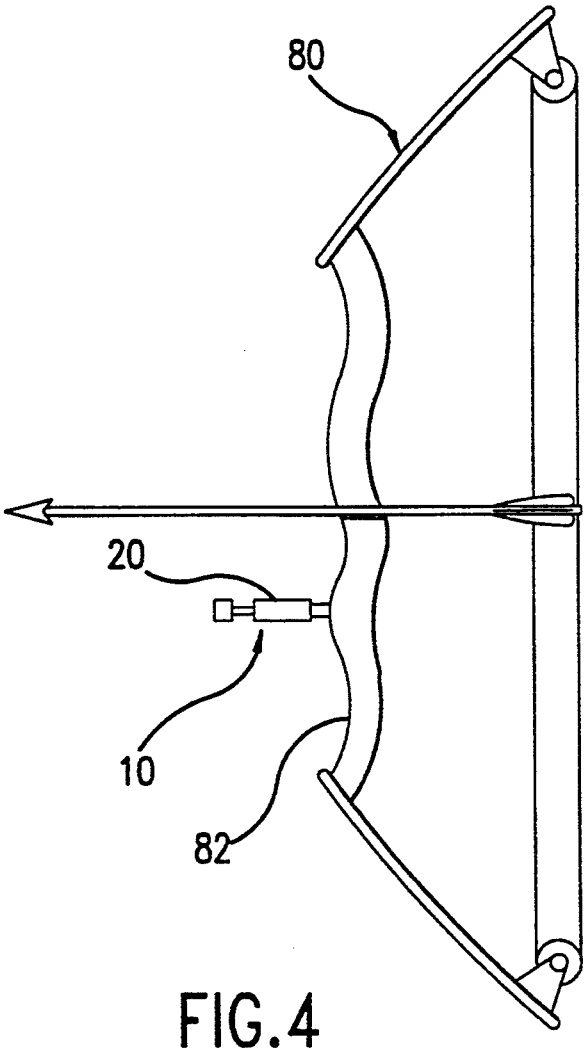
FIG. 4 is a plan view showing the stabilizer attached to a bow.

The instant pneumatic stabilizer is contemplated for use with an archery bow, although it could be utilized with any instrument subject to damaging vibrational energy (e.g. rifle, gun, etc.). FIG. 4 shows the stabilizer 10 secured to the bow riser 82 of an archery bow 80, where the stabilizer 10 is attached by the barrel 20 and the piston/rod/weight assembly is free to move when vibrational energy is applied (embodiment of FIG. 1). The embodiment shown in FIG. 2 could also be attached to an archery bow by securing the screw and jam nut of the piston to the bow riser. In addition to mounting the various embodiments, a plurality of stabilizers may be attached in series or parallel. Further, a variety of accessories may be used in combination with the stabilizer. Such accessories could include string game trackers, longer stabilizer rods and additional weights.

What is claimed is:

1. A stabilizer for an instrument for emitting a projectile comprising:

a spring;

wherein said spring consists of a gas spring;

a mass means for attachment to said spring; and means for attachment of the stabilizer to said instrument that is subjected to vibrational energy;

wherein the stabilizer functions to effectively absorb or dissipate the vibrational energy produced or imparted to the instrument, and wherein said spring has a non-linear spring constant.

2. A stabilizer according to claim 1, wherein said mass means includes securing means for releasably attaching said mass means to said spring.

3. A stabilizer according to claim 2, wherein said mass means includes a plurality of weights that are adapted to be releasably secured to said spring by said securing means.

4. A stabilizer according to claim 2, wherein said spring includes a piston positioned within a barrel, and a rod secured to said piston such that said rod extends from said barrel.

5. A stabilizer according to claim 4, wherein said rod includes said securing means.

6. A stabilizer according to claim 5, wherein said rod includes means for attaching the stabilizer to an instrument.

7. A stabilized archery bow comprising:

a conventional archery bow;

a stabilizer secured to said archery bow, wherein said stabilizer comprises:

a spring;

wherein said spring consists of a gas spring;

a mass means for attachment to said spring; and means for attachment of said spring to said archery bow;

wherein said archery bow has a composite of vibrational frequencies when said archery bow is fired, and said stabilizer has approximately the same composite of vibrational frequencies such that any vibrational energy produced by firing the bow is absorbed by said stabilizer, and wherein said spring has a non-linear spring constant.

8. A stabilized archery bow according to claim 7, wherein said mass means includes securing means for releasably attaching said mass means to said gas spring.

9. A stabilized archery bow according to claim 8, wherein said mass means includes a plurality of weights that are adapted to be releasably secured to said gas spring by said securing means in such a manner that the vibrational frequencies of said stabilizer are approximately equal to the vibrational frequencies of said archery bow.

10. A stabilized instrument comprising:

an instrument generally subjected to vibrational energy;

a stabilizer secured to said instrument, wherein said stabilizer comprises:

a spring including a piston positioned within a barrel, and a rod secured to said piston such that said rod extends from said barrel;

wherein said spring consists of a gas spring;

a plurality of weights for attachment to said spring, wherein said weights include securing means for releasably attaching said weights to said gas spring;

an optimized dampening element including a sealing member positioned between said piston and said barrel; and means for attachment of said spring to said instrument;

wherein said instrument has a composite of vibrational frequencies when vibrational energy is imparted to said instrument, and said stabilizer has approximately the same composite of vibrational frequencies such that any vibrational energy imparted to the instrument is absorbed by said stabilizer, and wherein said spring has a non-linear spring constant.

* * * * *